United States Patent [19]

English

[11] Patent Number: 4,663,945

[45] Date of Patent: May 12, 1987

[54] CIRCULAR HOSIERY KNITTING MACHINE DRIVE

[75] Inventor: John W. English, Lexington, N.C.

[73] Assignee: Kayby Mills of N.C., Inc., Thomasville, N.C.

[21] Appl. No.: 827,014

[22] Filed: Feb. 7, 1986

[51] Int. Cl.[4] ..... D04B 15/16; D04B 15/99

[52] U.S. Cl. ..... 66/56; 74/81

[58] Field of Search ..... 66/56; 74/81

[56] References Cited

U.S. PATENT DOCUMENTS

| | | | |
|---|---|---|---|
| 588,398 | 8/1897 | Cook | 66/56 X |
| 1,639,587 | 8/1927 | Bowers | 74/81 |
| 2,208,070 | 7/1940 | Clarke et al. | 66/56 X |
| 2,422,568 | 6/1947 | Larkin | 66/56 |

OTHER PUBLICATIONS

Moore, I. C.; *Textile World;* Mar. 1939, p. 82; 66/56.

*Primary Examiner*—Wm. Carter Reynolds

*Attorney, Agent, or Firm*—Bell, Seltzer, Park & Gibson

[57] ABSTRACT

A variable speed drive motor is provided for imparting rotation to the improved and simplified gear assembly of the present invention so that the main drive shaft may be rotated at selected rates of speed. The drive gears includes a segment gear continuously moved in a back-and-forth movement and being operable to selectively impart reciprocatory motion to a cylinder drive shaft. Resilient means, in the form of a compression spring, is supported by the frame of the machine and is positioned to be engaged by the segment drive gear during at least one end portion of the back-and-forth movement thereof to reduce the noise and vibration of the gear assembly and to permit operation of the knitting machine at increased rates of speed during both rotary and reciprocating knitting.

6 Claims, 4 Drawing Figures

CIRCULAR HOSIERY KNITTING MACHINE DRIVE

FIELD OF THE INVENTION

This invention relates generally to an improved drive for a circular hosiery knitting machine and more particularly to such a drive which permits the knitting machine to be operated at an increased rate of speed during both rotary and reciprocatory knitting and reduces the noise and vibration produced by the conventional drive.

BACKGROUND OF THE INVENTION

For many years, circular hosiery knitting machines were driven by belts engaging pulleys spaced along a driven line shaft. Each of the knitting machines included a belt shifting mechanism for moving the flat drive belt between an idler pulley, a low speed pulley and a high speed pulley mounted on one outwardly projecting end portion of the main drive shaft. The main drive shaft also included other drive gears drivingly connected to drive pinions on the cylinder drive shaft. The cylinder drive shaft was provided with rotary and reciprocatory drive pinions and clutch collars which were selectively engaged by a clutch to either impart rotary or reciprocatory motion to the cylinder drive shaft. The large number of gears and drive pulleys involved in driving the machine and selectively imparting rotary or reciprocatory movement at different speeds to the needle cylinder increased the noise and vibration generated by the drive gears and also played an important role in limiting the operating speed of the needle cylinder.

In order to eliminate the speed change pulleys and belt shifting mechanism used in circular hosiery knitting machines, it has been proposed that the knitting machine be provided with a speed change device, interposed either between the line shaft and the machine or between an individual drive motor and the machine. For example, U.S. Pat. Nos. 2,736,178; 3,390,548; and 3,390,751 illustrate knitting machines provided with such speed change devices. However, the addition of the speed change device did not change the conventional rotary and reciprocatory gear drive mechanism of the knitting machine and the above-mentioned problems of noise generation, vibration and speed limiting factors were not eliminated. In all of the aforementioned conventional drive arrangements, a segment gear continuously reciprocates in back-and-forth unrestricted movement during both reciprocatory and rotary movements of the needle cylinder and tends to limit the top operating speed of the machine. This unrestricted back-and-forth movement of the segment gear also produces noise and vibration in the driving gears.

SUMMARY OF THE INVENTION

With the foregoing in mind, it is an object of the present invention to provide an improved driving arrangement for the needle cylinder of a circular hosiery knitting machine which reduces the noise and vibration produced by the driving arrangement and also permits operation of the knitting machine at an increased rate of speed during both rotary and reciprocatory motion of the needle cylinder.

In accordance with the present invention, an individual variable speed drive motor is provided for the knitting machine and imparts the required rotational speed to the main drive shaft by means of a single drive pulley mounted on the outwardly projecting end of the main drive shaft. The main drive shaft is provided with only two drive gears, one for imparting movement to a rotary drive pinion drivingly connected to a rotary clutch collar mounted on the cylinder drive shaft, and the other for imparting movement to a reciprocatory drive pinion drivingly connected to a reciprocatory clutch collar mounted on the cylinder drive shaft and to which reciprocatory motion is imparted by a segment gear. The segment gear is drivingly connected to a segment drive gear by a connecting link and rotation is imparted to the segment drive gear by means of one of the drive gears on the main drive shaft. Electronic controls are provided for varying the speed of the variable speed drive motor and resilient means, in the form of a compression spring, is supported by the frame of the machine and positioned in alignment with and at one end of the path of travel of the segment gear so as to be engaged by the segment gear during only at least one end portion of the back-and-forth movement thereof to reduce the noise and vibration produced by the drive gears. The resilient restriction of the motion of the segment gear also permits the knitting machine to be operated at an increased rate of speed during both rotary and reciprocatory knitting.

BRIEF DESCRIPTION OF THE DRAWINGS

Other objects and advantages will appear as the description proceeds when taken in connection with the accompanying drawings, in which—

DESCRIPTION OF THE ILLUSTRATED EMBODIMENT

Figure 1:
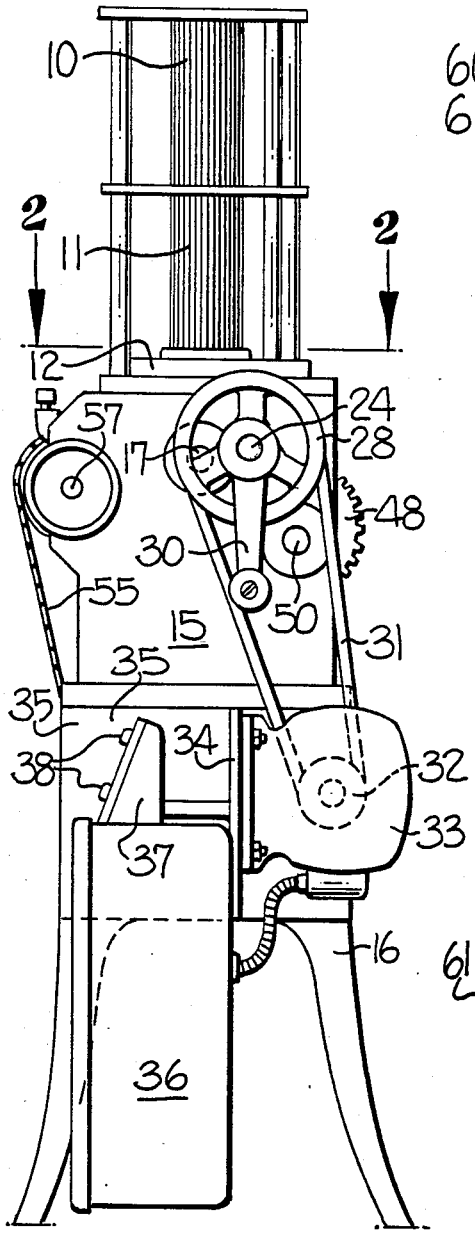
FIG. 1 is an elevational view of the right-hand side of a circular hosiery knitting machine with the present improved drive associated therewith.
Figure 2:
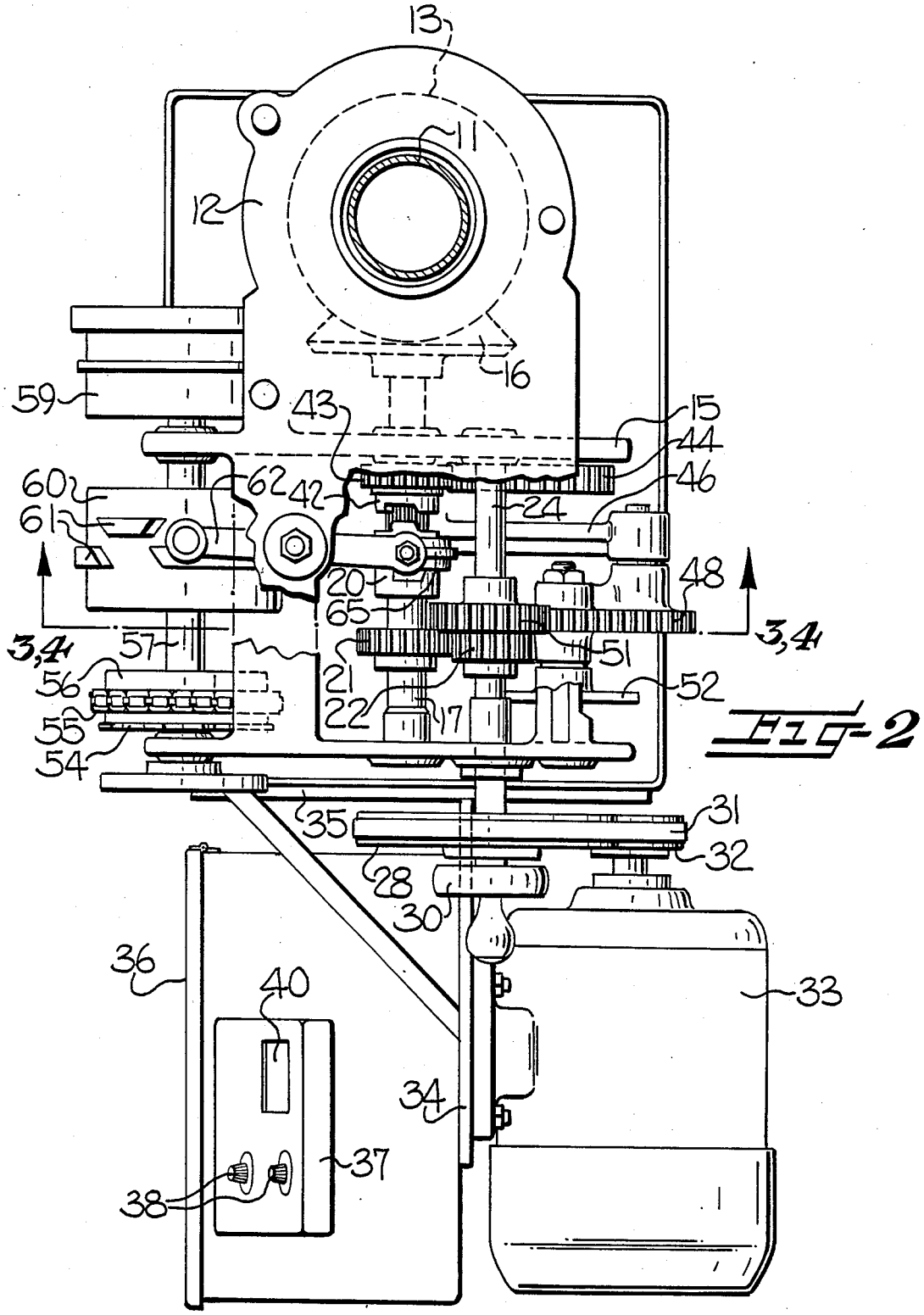
FIG. 2 is an enlarged sectional plan view taken substantially along the line 2—2 in FIG. 1 and with portions of the frame broken away for purposes of clarity.

The circular hosiery knitting machine illustrated in the drawings is of the type known as a Komet machine and includes respective upper and lower needle cylinders 10, 11 (FIG. 1) supported for rotation on a bed plate 12 and drivingly connected to a cylinder drive bevel gear 13, shown in dotted lines in FIG. 2. The lower bed 12 is supported on an upper frame 15 which is in turn supported on the upper portion of a lower frame 16 including front and rear legs.

A bevel gear 16 is drivingly mated with the cylinder bevel gear 13 and is fixed on one end of a cylinder drive shaft 17. The cylinder drive shaft 17 is supported for rotation in opposite side walls of the upper frame 15. A rotary clutch collar 20 is supported for rotation on the cylinder drive shaft 17 and is drivingly coupled to a rotary drive pinion 21 (FIG. 2). A rotary drive gear 22 drivingly engages the pinion 21 and is fixed on a main drive shaft 24. Opposite end portions of the main drive shaft 24 are supported for rotation in opposite side walls of the upper frame 15.

One end of the main drive shaft 24 extends outwardly beyond the upper frame 15 and has a drive pulley 28 fixed thereto. A handle 30 is attached to the outer end of the main drive shaft 24 for at times imparting manual rotation to the main drive shaft 24. A drive belt 31 drivingly connects the drive pulley 28 and the output pulley 32 (FIG. 1) of a variable speed drive motor 33. The variable speed drive motor 33 is supported on a vertical support plate 34 which is in turn fixed to a vertical support plate 35 fixed on one side of the lower frame 16. Suitable electronic control devices are housed in a control box 36 which is supported on the vertical support plate 34. An upstanding control panel 37 is supported on the control box 36 and includes stop and go switches 38 and a digital readout window 40 for indicating the speed of operation of the knitting machine. The electronic control device currently being used is of the type manufactured by Southern Industrial Controls of Charlotte, N.C. However, it is to be understood that other conventional electronic control devices may also be used to control the operation of the variable speed motor 33.

A reciprocatory clutch collar 42 (FIG. 2) is rotatably supported on the cylinder drive shaft 17 and is drivingly connected to a reciprocatory drive pinion 43. A quadrant or segment gear 44 drivingly engages the reciprocatory drive pinion 43 and is supported for back-and-forth movement on a shaft 45. Back-and-forth movement is imparted to the segment gear 44 by a connecting link 46, one end of which is connected to the segment gear 44 and the other end of which is connected in offset relationship to one side of a segment drive gear 48. The segment drive gear 48 is rotatably supported on a stub shaft 50 which is supported in one side wall of the upper frame 15. Rotation is imparted to the segment drive gear 48 by a drive gear 51 (FIG. 2) fixed on the main drive shaft 24.

A racking pawl cam wheel 52 is also supported on the stub shaft 50 and is driven by the gear 48 to impart reciprocating motion to a pattern chain drum racking pawl, not shown, which is adapted to engage and impart step-by-step movement to a pattern chain ratchet wheel 54 (FIG. 2) and a pattern chain 55 for controlling operation of the knitting machine in the usual manner. The pattern chain 54 is supported on a pattern chain sprocket 56 which is rotatably supported on a pattern drum shaft 57. The pattern drum shaft 57 is supported for rotation in bearings on the front portion of the opposite side walls of the upper frame 15. The pattern drum support shaft 57 also supports the usual pattern drum 59 and a clutch shifting drum 60. The clutch shifting drum 60 is moved in a step-by-step manner and in the usual manner and includes clutch shifting cams 61 supported thereon. A clutch shifting lever 62 is pivotally supported intermediate its ends on the horizontal portion of the upper frame 15 (FIG. 2) and its forward end is shifted back and forth by the control cams 61 as the drum 60 is rotated. The inner end of the clutch shifting lever 62 is operatively connected to a clutch member 65 supported for axial movement on the cylinder drive shaft 17 and keyed thereto.

Figure 3:
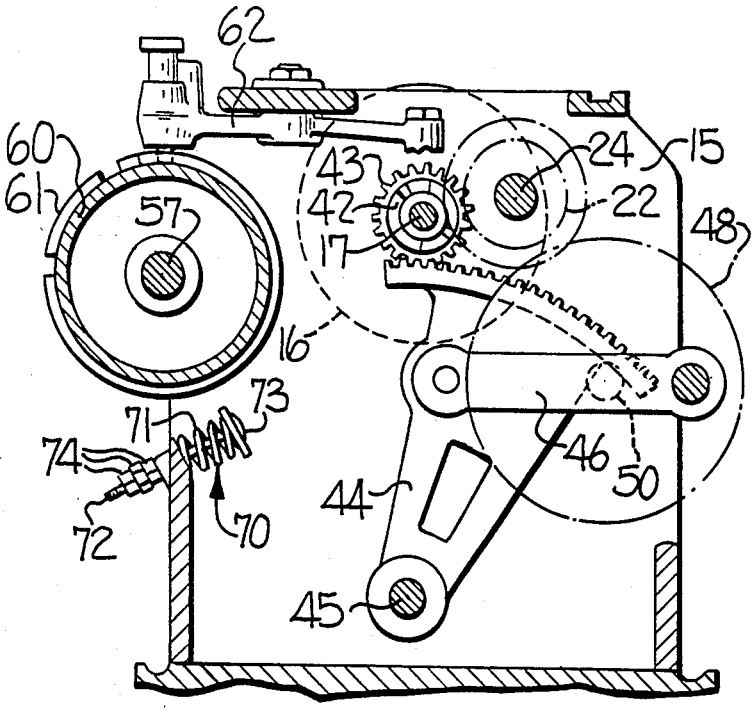
FIG. 3 is a vertical sectional view taken along the line 3—3 in FIG. 2 and with the segment gear in the rearmost position.
Figure 4:
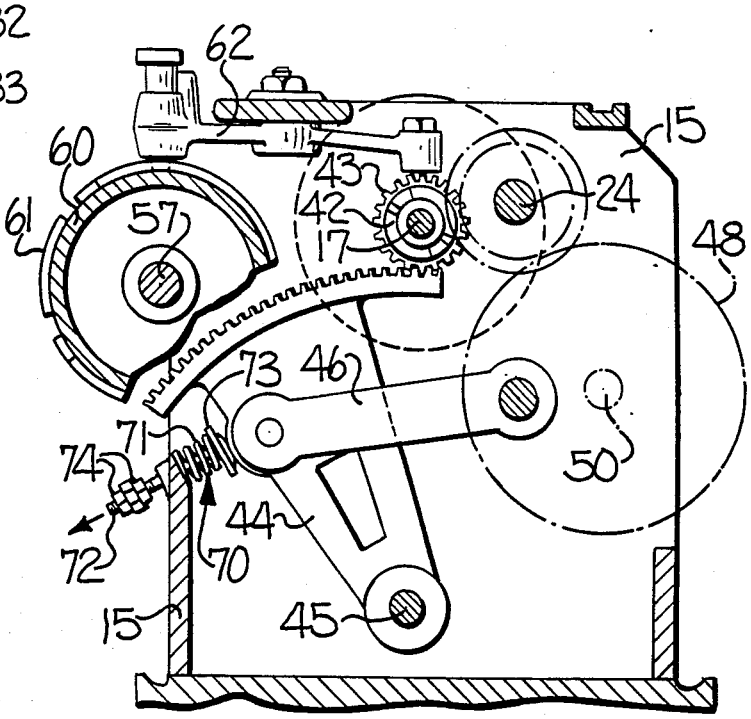
FIG. 4 is a view similar to FIG. 3 but showing the segment gear in the forward position and in engagement with the resilient cushioning means carried by the frame.

As illustrated in FIGS. 3 and 4, resilient means, broadly indicated at 70, is supported by the frame 15 and positioned in alignment with and at one end of the path of travel of the segment gear so as to be engaged by the segment gear 44 during only at least one end portion of the back-and-forth movement thereof. The resilient means 70 includes a compression spring 71 surrounding an adjustment bolt 72 having an enlarged inner head 73 and lock nuts 74 threadably supported thereon. The adjustment bolt 72 penetrates and is supported in a front wall of the upper frame 15 so that the compression spring 71 is in the normally extended position shown in FIG. 3. When the segment gear 44 is moved forwardly, it engages the enlarged head 73 and compresses the spring 71, moving the adjustment bolt 72 forwardly, as shown in FIG. 4. The position of the enlarged inner head 73 can be adjusted by adjusting the position of the lock nuts 74 along the forward end portion of the adjustment bolt 72.

Engagement of the segment gear 44 with the enlarged head 73 of the adjustment bolt 72 and compression of the spring 71 during only the endmost portion of the forward movement of the segment gear 44 tends to reduce the operational noise of the gears, reduces the vibration produced by the gears and permits the gear assembly to be operated at a greatly increased rate of speed over the rate of speed which was previously considered to be the top operating speed for the knitting machine. For example, this Komet type hosiery knitting machine, provided with the usual gears and without the resilient means 70, has normally been operated during rotary knitting, such as when knitting the leg and rotary knit foot portions of the sock at 150 rpm while operating at 95 rpm when reciprocating the needle cylinder, such as when knitting the heel and toe of the sock. With the present simplified gear arrangement and utilizing the resilient means 70, it has been possible to substantially increase the operating speed so that this same knitting machine operates satisfactorily during rotary knitting at 260 rpm and during reciprocatory knitting at 140 rpm.

The improved drive of the present invention thus includes an electronically controlled variable speed drive motor 33 which is drivingly connected to the main drive shaft 24 so that any desired number of revolutions per minute may be imparted thereto. The number of revolutions imparted to the main drive shaft 24 can be automatically varied by the electronic controls through operation of the pattern chain 55 so that various rotary and reciprocatory speeds of the needle cylinders 10, 11 can be obtained during the knitting of different portions of the sock. Only two drive gears 22 and 51 are fixed on the main drive shaft 24 and the rotary drive gear 22 imparts continuous rotation to the associated rotary drive pinion 21 and the rotary clutch collar 20 supported on the cylinder drive shaft 17. The drive gear 51 on the main drive shaft 24 continuously rotates the segment drive gear 48 and back-and-forth movement is continuously imparted to the segment gear 44 by the connecting link 46.

Continuous reciprocatory motion is imparted to the reciprocatory drive pinion 43 and the associated reciprocating clutch collar 42 by the segment gear 44. Depending upon the position of the clutch 65, either rotary or reciprocating motion can be imparted to the cylinder drive shaft 17 and the upper and lower needle cylinders 10, 11. When the clutch 65 is in the position shown in FIG. 2, that is in driving engagement with the rotary clutch collar 20, continuous rotary motion is imparted to the cylinder drive shaft 17 and the upper and lower needle cylinders 10, 11. When the clutch 65 is shifted in the opposite direction from that shown in FIG. 2, or into engagement with the reciprocatory clutch collar 42, the reciprocating motion from the segment gear 44 and the segment pinion 43 is imparted to the cylinder drive shaft 17 to impart corresponding reciprocating movement to the upper and lower needle cylinders 10, 11.

Thus, the gearing assembly of the knitting machine is considerably simplified by the present invention since only two drive gears 22, 51 are supported on the main drive shaft 24 and the resilient means 70 operates during both rotary and reciprocatory movements of the needle cylinders 10, 11 to reduce the noise and vibration produced, as well as to permit increased operating speed of the knitting machine. While the present invention has been described in association with a particular type of circular hosiery knitting machine, it is to be understood that this present improved gear drive system or assembly can also be associated with other types of circular hosiery knitting machines.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. In a circular hosiery knitting machine including a frame, and a needle cylinder supported for rotary are reciprocatory motion on said frame, the combination therewith of improved drive means for increasing the speed of both the rotary and reciprocatory motions of said needle cylinder, said improved drive means comprising a main drive shaft rotatably supported in said frame, a variable speed drive motor drivingly connected to said main drive shaft, a rotary drive gear fixed on said main drive shaft, a reciprocatory drive gear fixed on said main drive shaft, a cylinder drive shaft rotatably supported in said frame and in spaced parallel relationship to said main drive shaft, a bevel gear fixed on said cylinder drive shaft and drivingly connected to said needle cylinder, a rotary pinion rotatably supported on said cylinder drive shaft, a reciprocatory drive pinion rotatably supported on said cylinder drive shaft and in spaced relationship from said rotary pinion, a segment gear supported for back-and-forth movement and drivingly connected to said reciprocatory drive pinion on said cylinder drive shaft and being driven in said back-and-forth movement by means of said reciprocatory drive gear on said main drive shaft, a clutch member drivingly keyed to said cylinder drive shaft and being selectively shiftable in opposed axial directions along said cylinder drive shaft to be drivingly connected with either said rotary drive pinion to impart rotary motion to said needle cylinder, or said reciprocatory drive pinion to impart reciprocating motion to said needle cylinder, and resilient means supported by said frame and positioned in alignment with and at one end of the path of travel of said segment gear so as to be engaged by said segment gear only at one end portion of said back-and-forth movement thereof.

2. In a circular hosiery knitting machine according to claim 1 wherein said resilient means comprises a compression spring including one end fixedly supported on said frame and an opposite end positioned to be engaged by said segment gear only during the forward end portion of the back-and-forth movement thereof.

3. In a circular hosiery knitting machine according to claim 2 wherein said resilient means further comprises an adjustment bolt including one end portion extending through said frame, a medial portion extending through said compression spring, and an enlarged head end engaged by said compression spring, and wherein said enlarged head end is positioned to be engaged by said segment gear during the forward end portion of the back-and-forth movement thereof.

4. In a circular hosiery knitting machine according to claim 3 including lock nuts on the end portion of said adjustment bolt extending through said frame, said lock nuts being adjustable along said adjustment bolt to adjust the position of said enlarged head end of said adjustment bolt.

5. In a circular knitting machine according to claim 1 including electronic control means for controlling the operating speed of said variable speed drive motor.

6. In a circular knitting machine according to claim 5 including a pattern chain operable to control the operation of said knitting machine, and wherein said electronic control means is operable by said pattern chain to vary the speed of operation of said knitting machine during the knitting of various portions of a sock being knit by said knitting machine.

* * * * *